US005331374A

United States Patent [19]

Abe et al.

[11] Patent Number: 5,331,374

[45] Date of Patent: Jul. 19, 1994

[54] IMAGE FORMING APPARATUS CAPABLE OF OPENING A MAIN BODY ON ONE SIDE

[75] Inventors: Yuii Abe; Masuo Kawamoto; Masami Fuchi; Takeshi Uemura; Masahiki Miyazaki; Hiroyuki Ueda; Shinichi Kotera, all of Osaka, Japan

[73] Assignee: Mita Industrial Co., Ltd., Osaka, Japan

[21] Appl. No.: 90,448

[22] Filed: Jul. 8, 1993

[30] Foreign Application Priority Data

Jul. 13, 1992 [JP] Japan ..... 4-185561
Jul. 13, 1992 [JP] Japan ..... 4-185562
Jul. 13, 1992 [JP] Japan ..... 4-185564
Jul. 13, 1992 [JP] Japan ..... 4-185565

[51] Int. Cl.[5] ..... G03G 15/00
[52] U.S. Cl. ..... 355/200; 355/210
[58] Field of Search ..... 355/200, 308, 309, 310, 355/319, 321, 210; 346/160.1

[56] References Cited

U.S. PATENT DOCUMENTS 4,583,844 4/1986 Honda ..... 355/309
4,619,516 10/1986 Iwai ..... 355/245
4,751,552 6/1988 Itoigawa ..... 355/200
4,760,424 7/1988 Ohba et al. ..... 355/245
4,896,191 1/1990 Ohyabu et al. ..... 355/309
4,969,010 11/1990 Tamura et al. ..... 355/200 X
5,157,416 10/1992 Kinoshita et al. ..... 355/200 X

FOREIGN PATENT DOCUMENTS 0168158 8/1985 Japan ..... 355/200
0070771 3/1989 Japan ..... 355/210

*Primary Examiner*—A. T. Grimley
*Assistant Examiner*—William J. Royer
*Attorney, Agent, or Firm*—Jordan and Hamburg

[57] ABSTRACT

An image forming apparatus has a low body and an upper body connected to the lower body rotatable about a pivot. The upper body carries an image forming device. The lower body carries a copy paper storage unit and a paper feeding device for feeding a copy paper sheet from the paper storage unit to the image forming device. The paper feeding device is provided with a paper inverting device between the paper storage unit and the image bearing device for inverting the copy paper sheet fed from the paper storage unit. The paper feeding device is exposed to the operator when the upper body is opened.

10 Claims, 18 Drawing Sheets

IMAGE FORMING APPARATUS CAPABLE OF OPENING A MAIN BODY ON ONE SIDE

BACKGROUND OF THE INVENTION AND RELATED ART STATEMENT

This invention relates to an image forming apparatus provided with a clamshell-type mechanism for opening a main body on one side.

There have been known image forming apparatus, such as facsimile machines, copying machines, and printers, having a main body including an upper body and a lower body. The upper and lower bodies are connected at a pivot shaft on one side to open the main body on the other side. Such structure is intended to reduce the size of apparatus, and provide convenience in removing jammed copy paper and easy access to internal elements for inspection and maintenance.

An apparatus provided with such an opening mechanism has a normal state when the upper body is engagedly mounted on the lower body. When consideration is given to structural strength and stability as well as to ease of maintenance and paper jam treatment, there arise certain limitations in the arrangement of individual mechanical members and internal modules. Due to these limitations, it is difficult to reduce the size, weight and cost of the apparatus.

With recent improvements in the quality of synthetic resins and advances in resin molding technology, it would be preferable to utilize molded resins for mechanical members. However, since the upper body of such apparatus is required to have a specified structural strength to support relatively heavy internal modules which may include image reading means and image forming means, for example, it is a common practice to mainly employ iron plates and other metal members.

In particular, if the apparatus is configured to accommodate removable image reading and forming means in the upper body for easy assembly and maintenance, the upper body will be subjected to complex stresses when the apparatus is opened and closed, or when the internal modules are removed and mounted. Since such stresses tend to cause structural deformation and misalignment, metal members are extensively used to achieve the desired positioning accuracy of the internal modules although this will result in an increase in the weight of the upper body. Furthermore, as the upper body becomes heavier, the lower body is required to have more weight in order to bring down the center of gravity of the whole apparatus for its overall balance and stability. This is why it has been difficult to reduce the weight of the apparatus.

Since the apparatus provided with such an opening mechanism has its normal state when the upper body is entirely mounted on the lower body, it is extremely important to properly control the descending position of the upper body in relation to the lower body. To meet this requirement, the conventional apparatus is provided with separate vertical and horizontal positioning members. The vertical positioning member sets a limit to the descending stroke of the upper body's swinging side to determine its closed position in the vertical direction while the horizontal positioning member restricts lateral displacement of the upper body in the closed position to prevent its horizontal displacement in relation to the lower body. The vertical and horizontal positioning members work together to set the relative position of the upper and lower bodies when they are closed.

It is to be noted that the provision of the separate vertical and horizontal positioning members results in an increase in the number of mechanical members, making the mechanical structure complex. If there occurs a mutual displacement between the upper and lower bodies, remedy is rather complicated because the vertical and horizontal positioning members must be adjusted individually.

To easily remove jammed copy paper, it is preferable to divide the apparatus into upper and lower bodies along a paper path. With this configuration, it would be possible to expose the paper path by opening the apparatus to remove jammed copy paper. One approach to achieve such structure in a compact design is to provide the apparatus with a paper feeding mechanism in an upper portion of the lower body, a copy paper cassette for storing a stack of copy paper sheets inside the lower body, and a paper inverting mechanism for quickly turning the feed direction of the copy paper sheet fed from the Copy paper cassette to the paper feeding mechanism upward.

As an example, the apparatus may be provided with a feed roller assembly for sequentially feeding sheets of copy paper from the copy paper cassette. The feed roller assembly comprises a rotating shaft carrying one or more pieces of friction rollers at intermediate portions. One end of the rotating shaft is connected to a drive mechanism. The rotating shaft is usually fitted into bearing holes in side members and retained by E-rings at both ends, for example, for restricting its longitudinal displacement, yet allowing the shaft to rotate.

On the other hand, the paper feeding mechanism usually comprises a pair of registration guide rollers, for example, one being a driving roller and the other being a driven roller, for conveying the copy paper fed from the copy paper cassette to a photosensitive drum. The registration rollers are mounted on side members at their respective positions. Consequently, an appropriate pressure is produced between the two registration rollers without causing longitudinal displacement as they rotate.

Although the above-mentioned feed roller assembly and registration guide rollers are arranged to provide an accurate feed of the copy paper sheet without displacement of individual rollers, their structural complexity impairs productivity and serviceability, requiring complicated procedures for assembly and replacement of individual components.

It is an object of the present invention to provide an image forming apparatus which has overcome the above-mentioned problems.

It is another object of the present invention to provide an image forming apparatus which is compact and light as well as having a sufficient strength, and simple in construction, and assure easy maintenance.

SUMMARY OF THE INVENTION

Accordingly, an image forming apparatus of the invention comprising a lower body having a pivot shaft on one side; an upper body connected to the lower body and rotatable about the pivot shaft; image forming means having an image bearing member for forming a toner image on the image bearing member; paper storage means provided on the lower body for storing copy paper sheets; and paper feeding means provided in the lower body for feeding a copy paper sheet from the paper storage means to the image forming means, the paper feeding means including paper inverting means provided between the paper storage means and the image bearing member for inverting the copy paper sheet fed from the paper storage means, whereby the paper feeding means is exposed when the upper body is opened.

With the thus constructed image forming apparatus, the copy paper sheet fed from the paper storage means is inverted by the paper inverting means, and fed to the image forming means. Accordingly, the feeding path is compact, which enables reduction of the size of apparatus. Also, when the upper body is opened, the paper feeding means is exposed to the operator. Accordingly, jammed paper can be eliminated easily.

Also, a pair of registration rollers may be supported by roller supporting members for supporting the registration roller pair. The supporting member may be a plate fixedly attached on the lower body and formed with an oblong cutout for holding the mounting portions, the cutout facing upward.

With this construction, the registration roller pair is upward detachably supported. Accordingly, when the upper body is opened, the registration roller pair can be dismounted with ease.

The upper body may be constructed by a front frame member and a rear frame member, these member being made of resin, and a connecting member between the front frame member and the rear frame member for connecting the front and rear frame members, the connecting member being made of a metal. Also, the frame member may be made of a vertical portion and a flange portion formed on a periphery of the vertical portion, the vertical and flange portions being connected to the connecting member. Further, image reading means may be further provided to connect the front and rear frame members to each other.

With this construction, the front and rear frame members are made of resin. This reduces the weight of the apparatus. Also, the front and rear frame members are connected to each other by the metal connecting member. This reduces the torsional stress when opening or closing the upper body, and assures accurate coupling of the upper and lower bodies. Further, since the image reading means is additionally provided to connect the front and rear frame members, the connection of the front and rear frame members is further reinforced.

The image forming means may be constructed by an operable unit detachably mountable on the upper body. The front frame member may be formed with a guide passage for guiding the mounting of the operable unit to the upper body. The guide passage may be formed so as to flare in an outward direction. Further, the connecting member may be used as a guide for guiding the mounting of the operable unit to the upper body.

These constructions assure easy construction and maintenance of the apparatus because the image forming means is made of a detachable operable unit, and the guide passage is provided. Also, the connecting member is used as the operable means guide, which reduces the number of parts and simplifies the construction.

Further, one of the upper body and lower body may be provided with positioning means including a hole portion. The other one is provided with a projection fittable in the hole portion when the upper body is placed in the closed state. The positioning means may be a connecting member formed with a cutout having a hole portion and a narrow entry portion. The projection may be formed on a supporting plate for supporting the registration roller pair.

With these constructions, the projection is inserted into the hole portion of the positioning means while the upper body is being closed. Accordingly, displacement of the upper body relative to the lower body can be restricted. The internal elements carried by the upper body can be accurately set in positions cooperationally corresponding to the internal elements of the lower body. Also, the positioning means is formed in the connecting member while the projection is formed in the registration roller supporting plate, which reduces the number of parts.

Further, feed roller means may be provided on the downstream side of the paper storage means for feeding the copy paper sheets from the paper storage means, feed roller supporting means, and restricting means. The feed roller means is made of a feeding roller and a supporting shaft having on the opposite ends thereof mounting portions. The feed roller supporting members for supporting the feed roller means are made of a plate fixedly attached on the lower body and formed with an oblong cutout for holding the mounting portions of the feed roller means, the cutout facing upward. The restricting means is detachably provided on the lower body for holding the mounting portions of the feed roller means from moving upward when the upper body is placed in the closed state. Also, the restricting means may be registration roller supporting members attached on the lower body and formed with a portion for holding the mounting portions of the feed roller means in place.

With these constructions, the feed roller means is detachable from the lower body and restricted by the restricting means detachable from the lower body. Accordingly, the feed roller means can be replaced with ease. Also, the feed roller means is restricted by the registration roller supporting members. Accordingly, the feed roller means can be restricted by the simpler construction.

These and other objects, features and advantages of the present invention will become more apparent upon a reading of the following detailed description and accompanying drawings.

BRIEF DESCRIPTION OF THE DRAWINGS

FIG. 20A showing a state where the leading end of the copy paper has just gone onto the U-turn guide plate, FIG. 20B showing a state where the leading end of the copy paper is just nipped by a pair of registration rollers, and FIG. 20C showing a state where the copy paper is being fed by the registration rollers.

DETAILED DESCRIPTION OF THE PREFERRED EMBODIMENTS OF THE INVENTION

Figure 21:
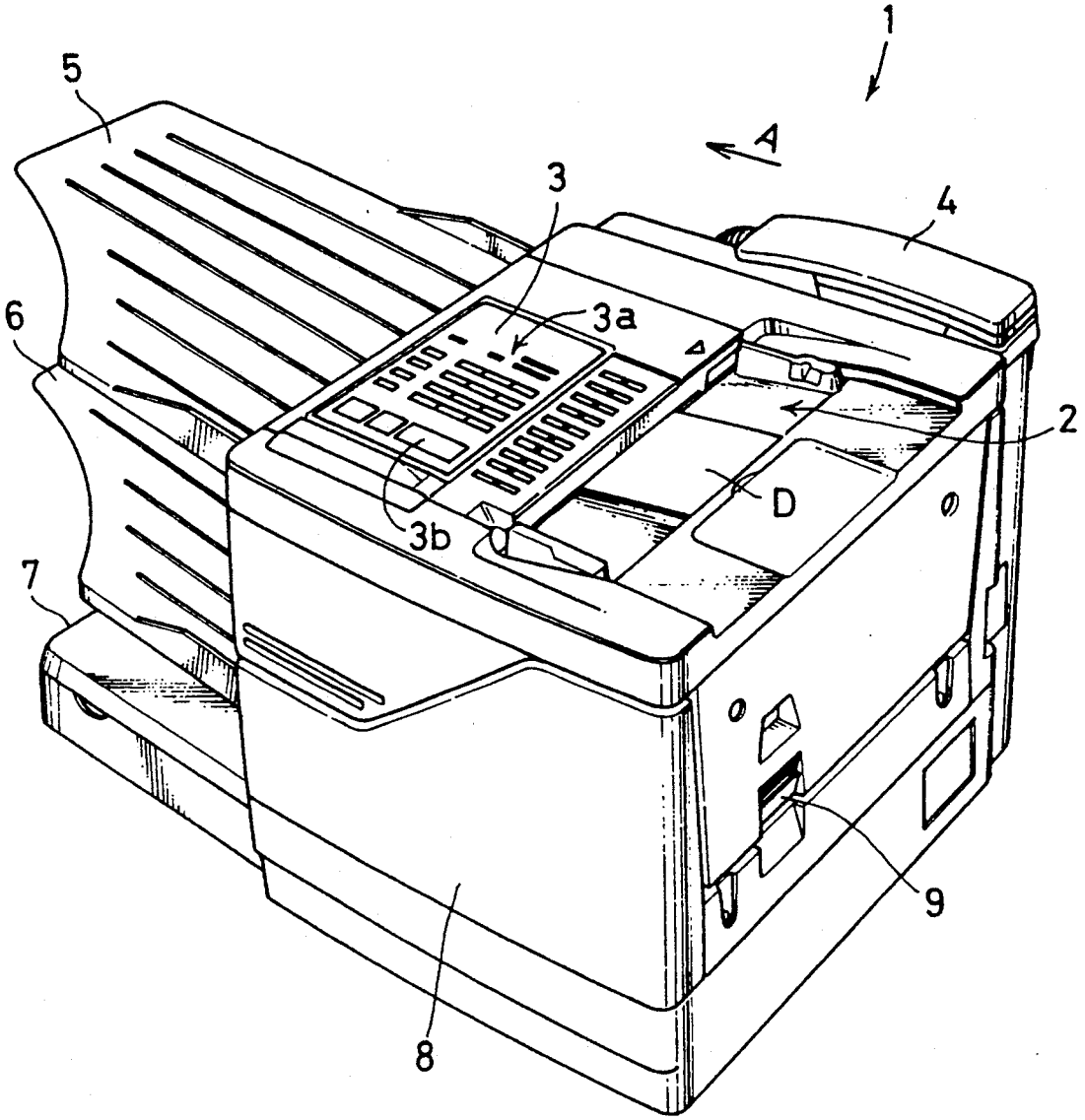
FIG. 21 is a perspective view showing an external appearance of the facsimile machine embodying the present invention.

FIG. 21 is a perspective view showing an external appearance of a facsimile machine embodying the present invention.

Provided with the functions of dedicated facsimile transmission and image forming, the facsimile machine shown in FIG. 21 not only forms a copy image of a transmitted image but also an image of an original document on a cut copy sheet.

The facsimile machine has a main body 1. As shown in FIG. 21, the main body 1 is formed with a document feeder tray 2 on a right portion of a top surface thereof, a control panel 3 on a left portion of the top surface, and a wired telephone handset 4 at a rear end of the top surface. The control panel 3 includes numeric keys, function keys 3*a* for setting various functions and operating conditions required for facsimile transmission and image forming, and a display window 3*b* for displaying set parameters and other information.

The main body 1 incorporates image reading means and image forming means individually constructed in the form of discrete modules. The image forming means further comprises a plurality of detachable sub-units as will be discussed later. The image forming means itself can be dismounted from and mounted into the main body 1 after opening its front cover 8.

On a left side of the main body 1, there are provided a document discharge tray 5 for receiving an original document read by the image reading means and a copy sheet discharge tray 6 for receiving a copy sheet bearing an image formed by the image forming means. On a lower left side of the main body 1 is mounted a copy sheet cassette 7 for holding a stack of standard-size cut copy sheets. The copy sheet is fed from the copy sheet cassette 7 to the image forming means.

As will be seen later, the main body 1 is divided into an upper body and a lower body. The upper body is connected to the lower body in such a manner that a right side of the upper body can be turned about a pivot shaft on a left side. The right side of the upper body is normally locked to the lower body by a locking mechanism. The upper body is so biased upward by a spring as to flip up in the counterclockwise direction when the lock is released. Mechanisms for assembling and locking the upper and lower bodies will be discussed later in further detail.

There is provided a release lever 9 for releasing the lock between the upper and lower bodies on the right side of the main body 1. The locking mechanism is released when the release lever 9 is pushed upward. The right side of the upper body flips up and swings in the counterclockwise direction with the aid of springs to open the right side of the main body 1.

Figure 3:
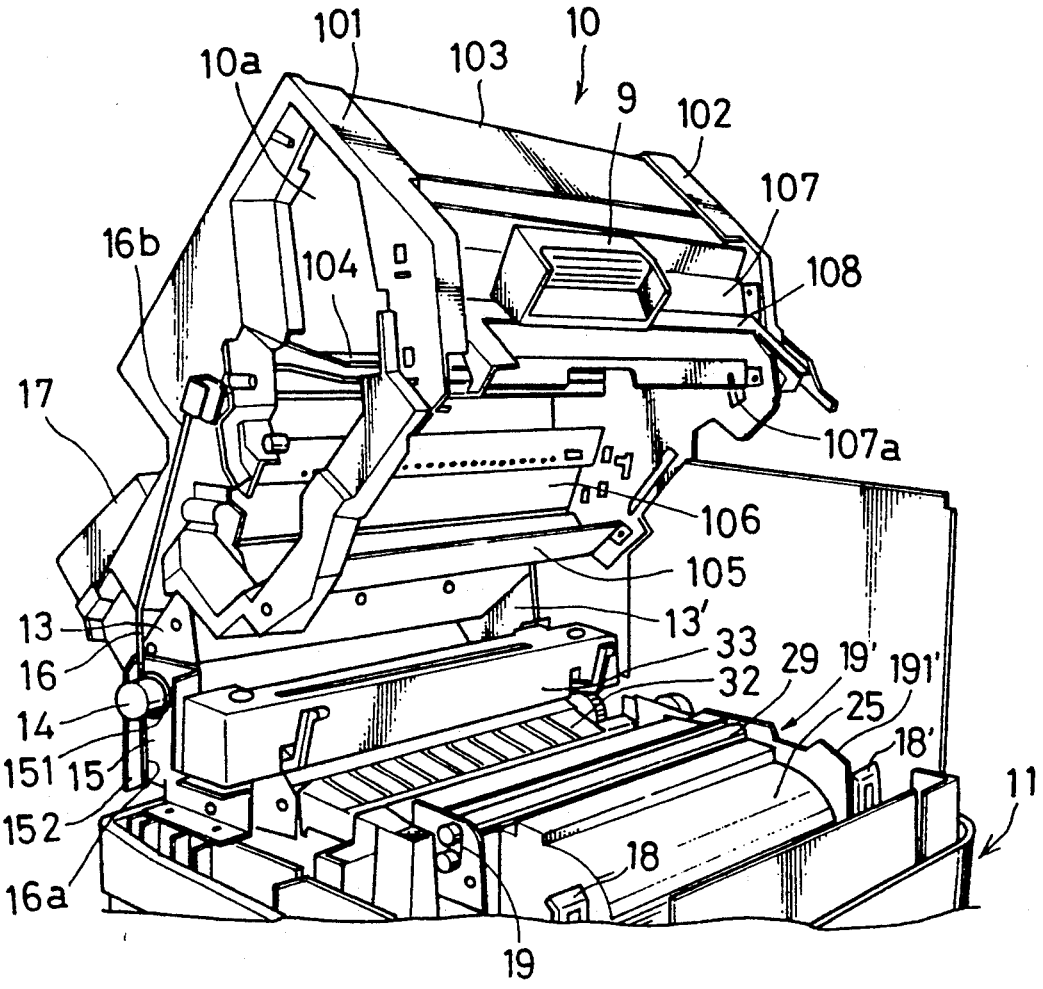
FIG. 3 is a perspective view showing an interior of the machine with its upper and lower bodies opened wide.
Figure 4:
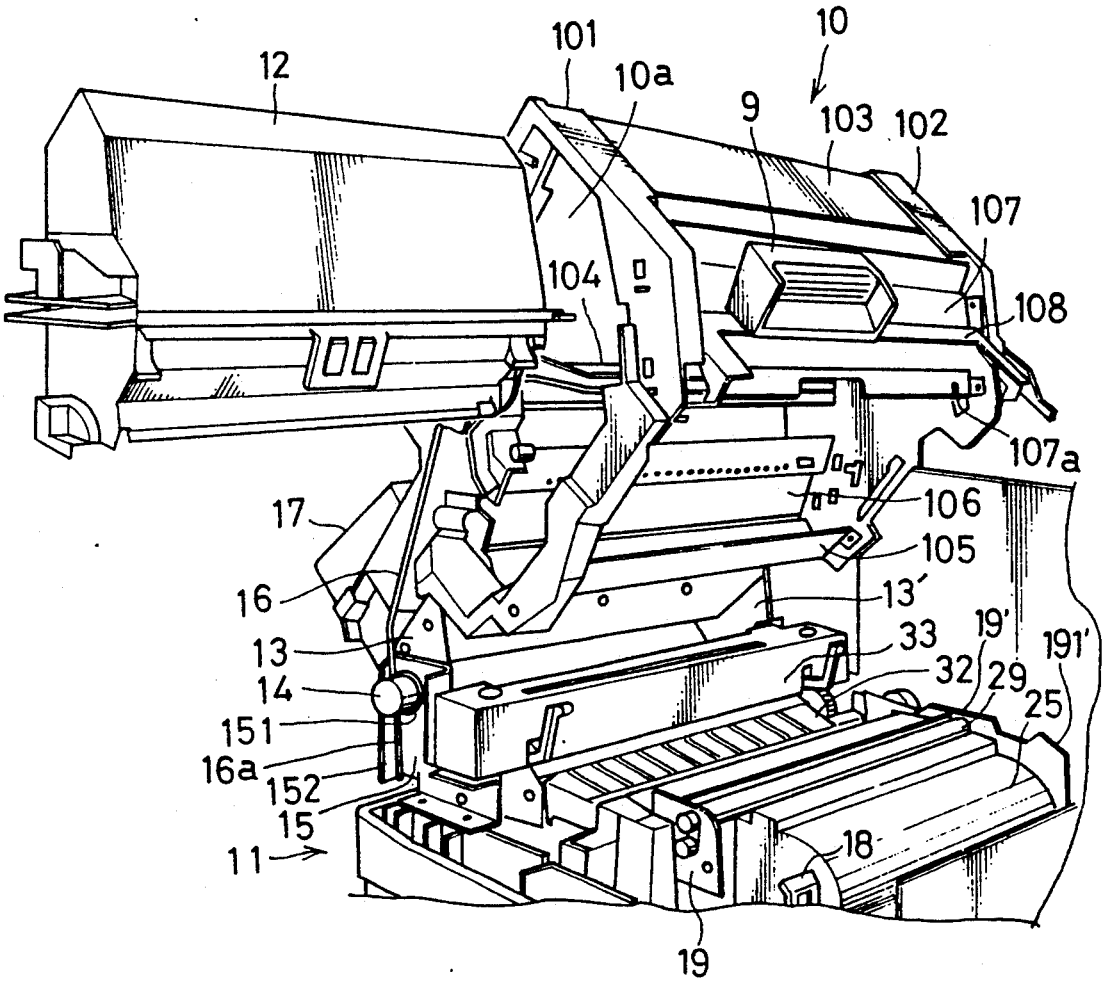
FIG. 4 is a perspective view similar to FIG. 3, but additionally showing a developing unit.

FIG. 3 is a perspective view showing an interior of the main body 1 with its upper body 10 and lower body 11 opened wide. FIG. 4 is a perspective view similar to FIG. 3, but additionally showing a developing unit 12, a part of the image forming means.

Major structural members of the upper body 10 are a front frame member 101, a rear frame member 102 and a plurality of reinforcing members 103 to 106. The front frame member 101 and rear frame member 102 are usually one-piece molded resin members while the reinforcing members 103 to 106 are metal plates to reinforce the connection between the front frame member 101 and rear frame member 102 and prevent them from twisting. The upper body 10 has an image reading means 17 mounted at an upper left position. The upper body 10 is designed in such a manner that a developing unit 12 and the other parts of the image forming means can be inserted into the main body 1 through the front frame member 101. As will be described later, the front and rear frame members 101 and 102 are formed with flanges, each having a specified width in the longitudinal direction. These flanges are adapted for guiding the developing unit 12 as it is inserted.

Figure 1:
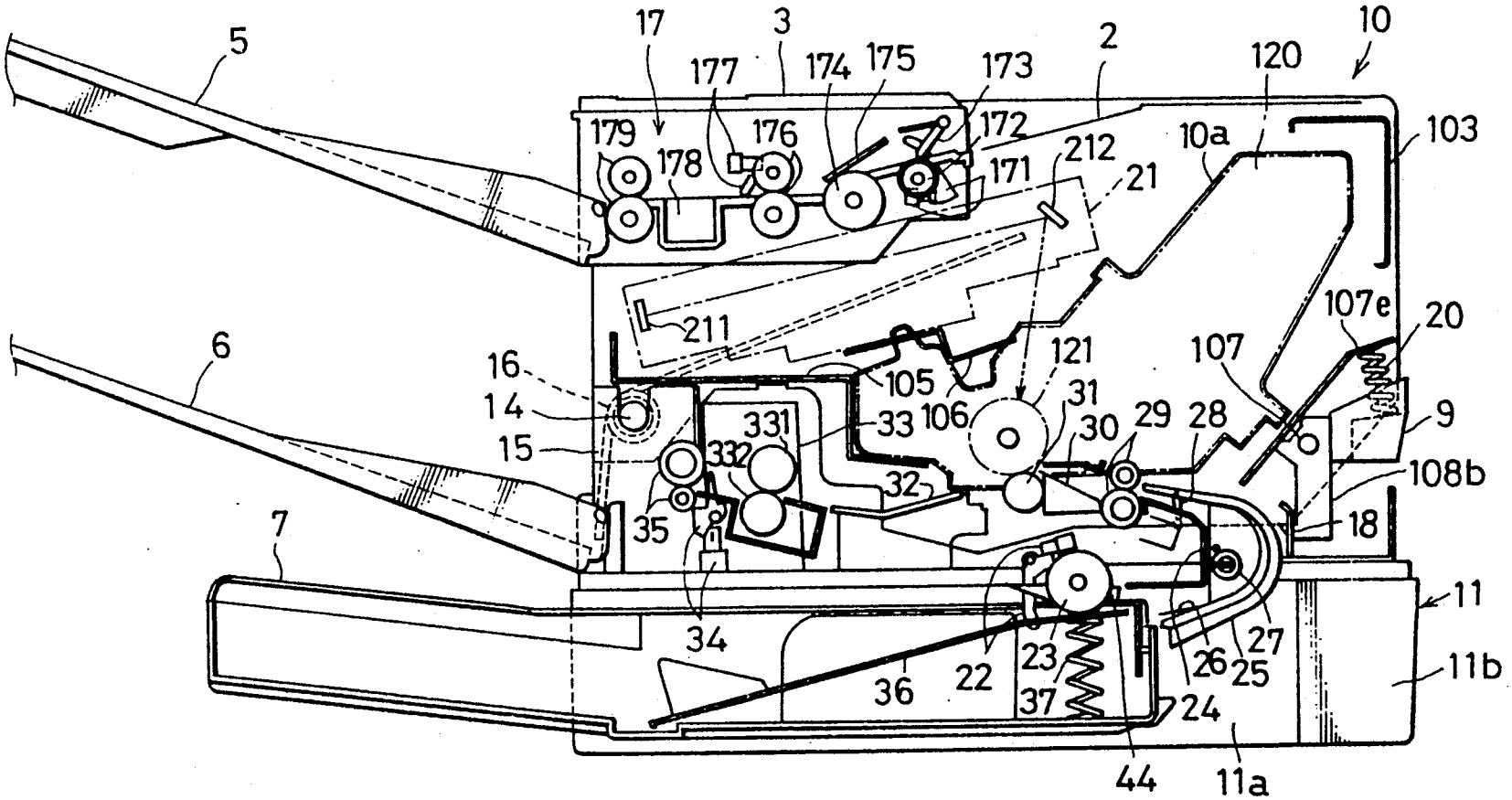
FIG. 1 is a diagram schematically showing an internal construction of a facsimile machine, one preferred embodiment of the present invention, in a closed position.

The reinforcing member 103 is formed into an L-shaped cross section as seen in FIG. 1. The reinforcing member 104 serves also as fixing plate for the front frame member 101 and rear frame member 102. The reinforcing members 105 and 106 serve also as fixing plate for an optical unit 21 shown in FIG. 1, which is a part of the image forming means to be described later. The reinforcing member 105 further serves as insertion guide plate for internal elements. A positioning member 107 is provided to set a lowermost position of the upper body 10 as it descends on the lower body 11. Indicated at 108 is a hook member for locking the upper body 10 to the lower body 11. The hook member 108 also serves as fixing plate for the release lever 9. The construction and operation of the positioning member 107 and hook member 108 will be described later.

Figure 5A:
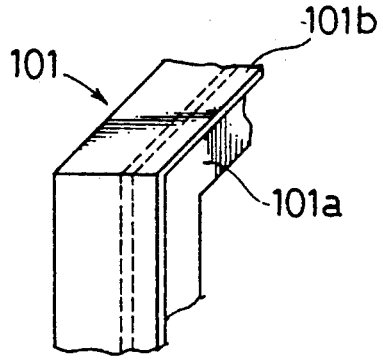
FIG. 5A is a perspective view showing a portion of a frame member of the upper body.
Figure 5B:
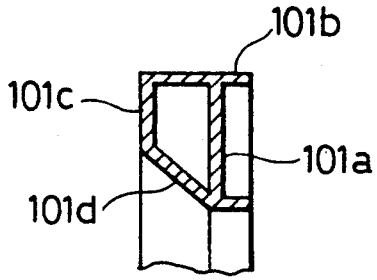
FIG. 5B is a sectional view of the portion shown FIG. 5A.
Figure 6A:
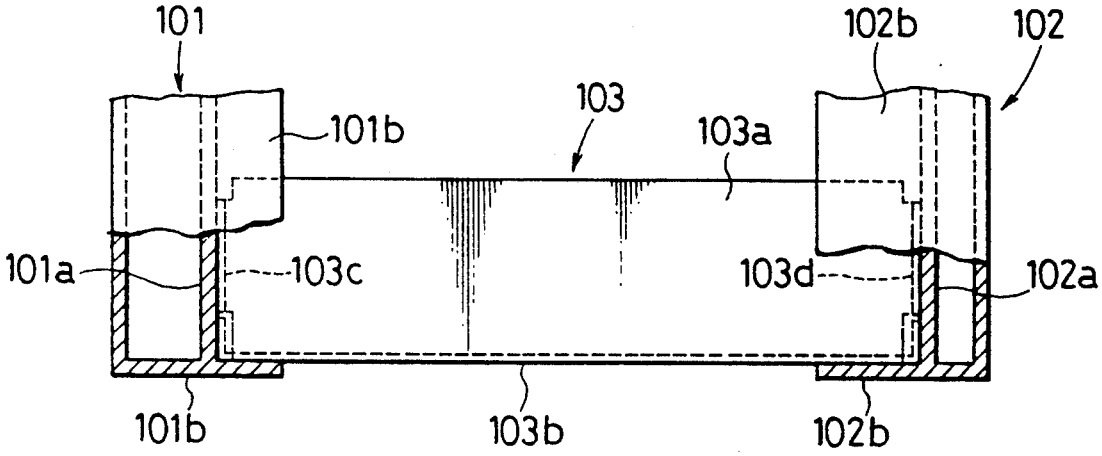
FIGS. 6A and 6B are a plan view and a right side view partially in section, respectively, showing a connection of front and rear frame members by a reinforcing member.
Figure 6B:
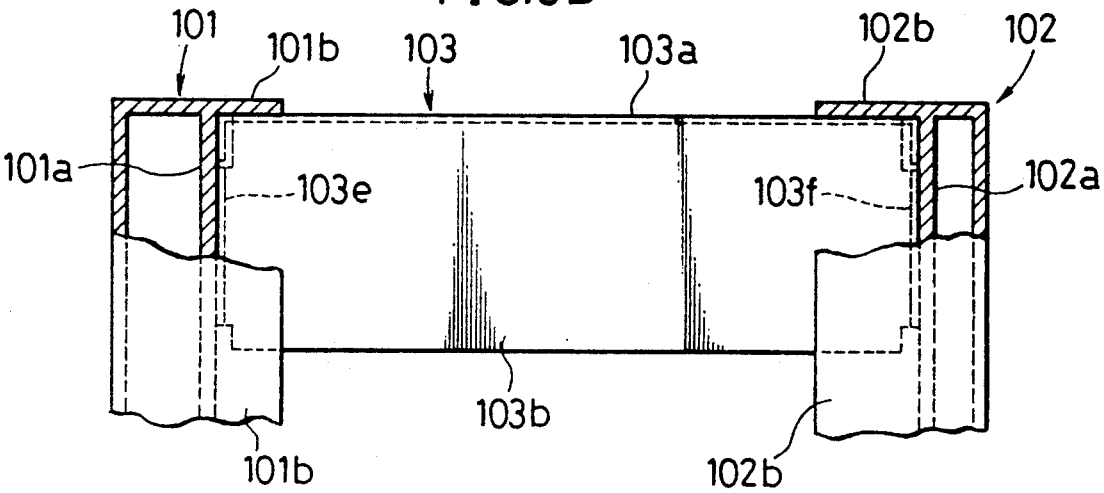

FIGS. 5A and 5B are a fragmentary perspective view and a fragmentary cross sectional view, respectively, showing the shape of the front frame member 101. FIGS. 6A and 6B are a plan view and a right side view partially in section, respectively, showing how the front frame member 101 and rear frame member 102 are connected by the reinforcing member 103.

The front frame member 101 has a specified width and formed with a flange portion 101*b* on a periphery of an inner face portion 101*a*. The flange portion 101*b* is perpendicular to the inner plate portion 101*a*. In an intermediate portion of the front frame member 101 is formed a passage 10*a* through which the internal elements are inserted. An outer face portion 101*c* has a fan-like cross section to give a greater opening to the front of the passage 10*a* compared to the inside. Since the outer face portion 101*c* is broadening outward, it will serve as guide when inserting internal elements.

Like the front frame member 101, the rear frame member 102 has a specified width and is formed with a flange portion 102*b* on a periphery of the inner face portion 102*a*. The flange portion 102*b* is perpendicular to the inner face portion 102*a*. However, the rear frame member 102 has no opening.

As seen in the above description, the front and rear frame members 101 and 102 have a specified width. The passage 10*a* is defined by the outer face portion 101*c* serving as guide and is widened outward. Accordingly, the internal elements can be easily loaded to and removed from the upper body 10.

On the other hand, the reinforcing member 103 is formed by bending a single metal plate. The plate 103 has an upper face portion 103*a* which is a part of the top of the upper body 10, a right face portion 103*b* which is a part of the right side surface of the upper body 10, and a front face portion 103*c* and a rear face portion 103*d* which are connected to the inner face portion 101*a* of the front frame member 101 and the inner face portion 102*a* of the rear frame member 102 respectively, as shown in FIGS. 6A and 6B.

The front face portion 103*c* and rear face portion 103*d* of the reinforcing member 103 are connected to the inner face portion 101*a* of the front frame member 101 and the inner face portion 102*a* of the rear frame member 102, respectively. Further, both ends of the upper face portion 103*a* and both ends of the right face portion 103*b* are connected to the flange portions 101*b* and 102*b* of the front frame member 101 and rear frame member 102. As seen above, the front frame member 101 and rear frame member 102 are united to each other by the reinforcing member 103 by the inner face portions 101*a* and 102*a*, and the flange portions 101*b* and 102*b*. This construction effectively prevents deformation due to torsional stresses.

Figure 7:
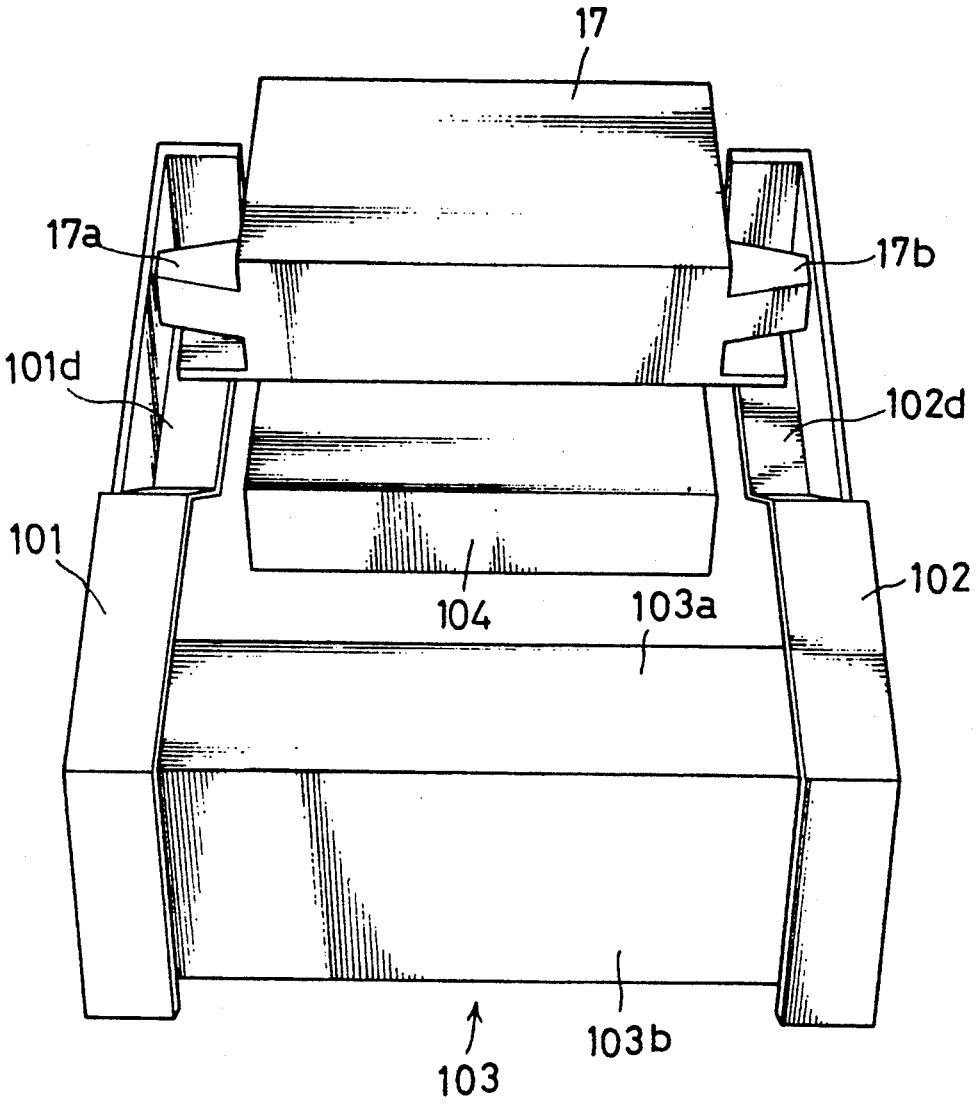
FIG. 7 is a perspective view showing mounting of an image reading means on the front and rear frame members.

Furthermore, the front frame member 101 and rear frame member 102 are reinforced by the image reading means 17 mounted in the upper body 10. This will be seen more specifically in the following. Referring to FIG. 7 showing a perspective view of a right side of the upper body 10 as viewed at an elevated angle, the image reading means 17 has projections 17*a* and 17*b* at both ends of its housing. The projections 17*a* and 17*b* are fittable in recesses 101*d* and 102*d* formed in the upper portions of the front frame member 101 and rear frame member 102, respectively. The projections 17*a* and 17*b* are fixedly attached by screws, for example, from the outside to hold the image reading means 17 on the upper body 10. Fixedly attached to the front frame member 101 and rear framing member 102 at the both ends, the image reading means 17 serves as a stay for connecting the two frame members 101 and 102 together. The connection between the front frame member 101 and rear frame member 102 is made more rigid providing an enhanced anti-torsional effect.

As seen in the above discussion, the front frame member 101 and rear frame member 102 made of integrally molded resin members are connected together by a plurality of metal reinforcing members 103 to 106 at several points. This is why the front frame member 101 and rear frame member 102 are not easily deformed due torsional stresses which are likely to occur when swinging up and down the upper body 10 or when loading and removing the developing unit 12 or other internal modules.

Referring again to FIG. 3, there are provided at a left side of the upper body 10 a pair of fixing plates 13 and 13', each having a pivot shaft 14 projecting outward. On the other hand, there are provided a pair of supports 15 placed face to face with the fixing plates 13 and 13' at the left side of the lower body 11. Each support 15 has a through hole 151 fittable on the pivot shaft 14.

The upper body 10 is connected to the lower body 11 by inserting the pivot shafts 14 into the holes 151 in the supports 15. Accordingly, the right side of the upper body 10 can be swung up and down. Further, two coil springs 16, each having a helical winding in an intermediate portion, are mounted on the two pivot shafts 14. A lower end 16*a* of each coil spring 16 is hooked on a bent portion 152 of the supports 15. On the other hand, an upper end 16*b* of the coil spring 16 is fixedly attached on an appropriate position of the front frame member 101 or rear frame member 102. The resilient force of the coil spring 16 causes the upper body 10 to swing in the counterclockwise direction to a specified angle. With this arrangement, the right side of the main body 1 is opened to a convenient position when the locking mechanism is released by pushing up the release lever 9.

To close the main body 1 from its fully opened position, the right side of the upper body 10 should be pushed downward. When the upper body 10 is fully pushed down, it is automatically locked to the lower body 11. More specifically, the upper body 10 turns about the pivots 14 in the clockwise direction when its right side is pushed down. When the right side of the upper body 10 reaches the lower-most position, the swinging motion of the upper body 10 is curbed by the previously mentioned positioning member 107 and the upper body 10 is locked to the lower body 11 by the hook member 108.

Figure 8A:
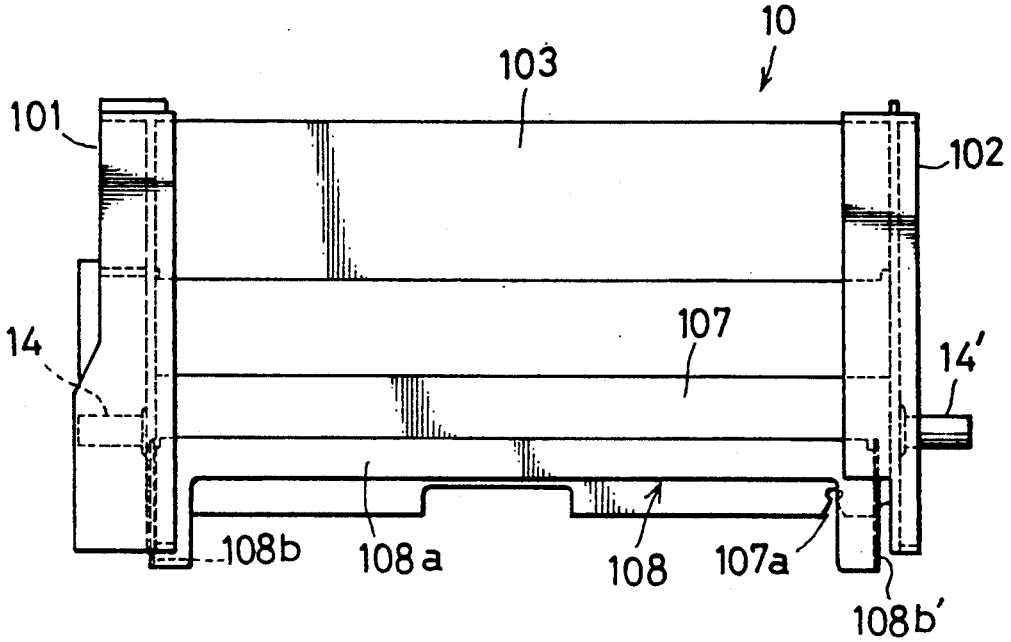
FIG. 8A is a right side elevation view of the upper body generally showing a construction of a positioning member and a hook member.
Figure 8B:
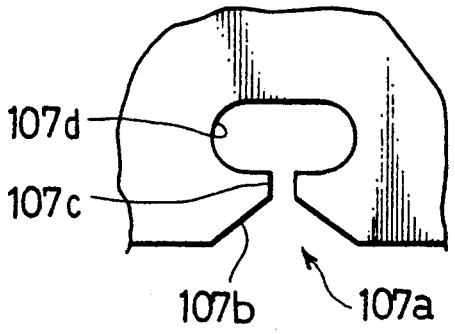
FIG. 8B is an enlarged view a portion of the positioning member showing a concave cutout.
Figure 9:
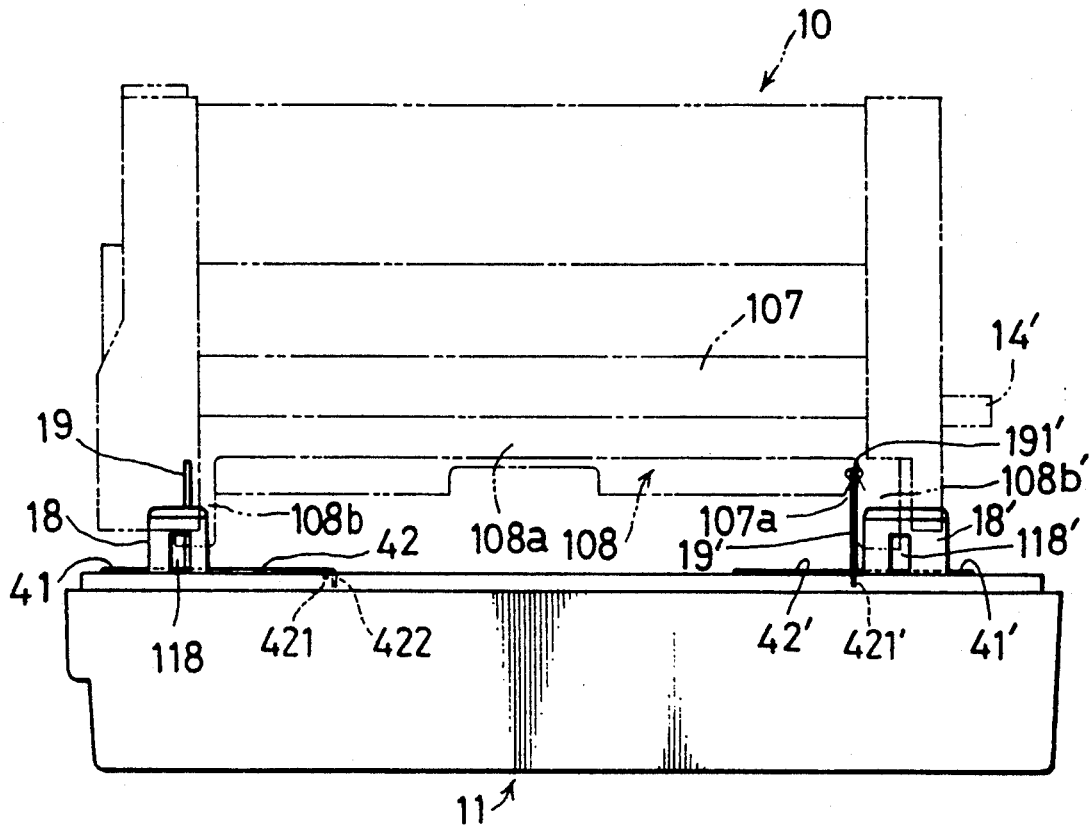
FIG. 9 is a right side view showing a locking mechanism between the upper and lower bodies.
Figure 10:
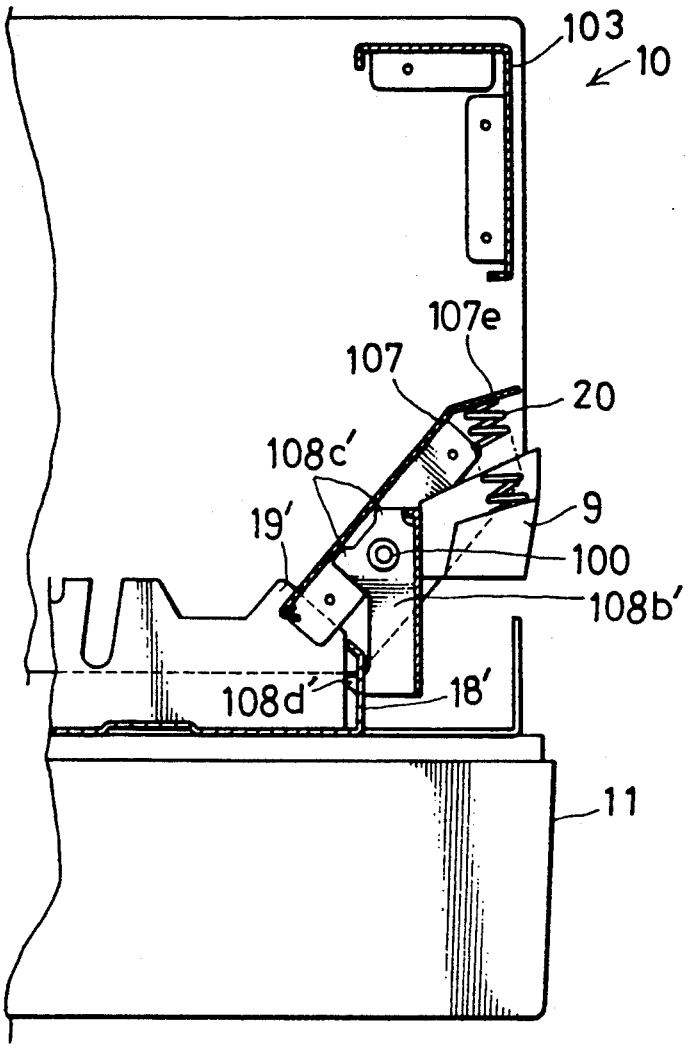
FIG. 10 is a partly cutaway front view of a portion of the upper body showing a construction of the positioning member and hook member.

FIGS. 8 a through 10 are diagrams showing a construction of the positioning member 107 and hook member 108. FIG. 8A is a right side elevation view of the upper body 10 while FIG. 8B is a fragmentary enlarged view showing a concave cutout in the positioning member 107. FIG. 10 is a fragmentary front view of the upper body 10 partially in section. FIG. 9 is a fragmentary right side view showing the locking mechanism between the upper body 10 and lower body 11.

On a lower end of the positioning member 107, close to the rear frame member 102, there is formed a cutout 107*a* for regulating the descending upper body 10. The cutout 107*a* has a fan-like portion 107*b* joining a narrow entry portion 107*c* and a hole portion 107*d* having a specified depth, as shown in FIG. 8B.

An upper end of the positioning member 107 is bent outward at a specified angle to form a slant portion 107*e*, as shown in FIG. 10. The lower end of the positioning member 107 is bent to the inside of the upper body 10 and is fixed to the upper body 10.

The hook member 108 includes a connecting portion 108*a* of which front and rear ends are bent at right angles to form engaging ends 108*b*, and a pair of projections 108*c* close to its upper end, and a hook 108*d* at a lower end of the engaging end 108*b*. The projections 108*c* are properly located for regulating the angular movement of the hook member 108. The aforementioned release lever 9 is fixed at the center or other appropriate position of the connecting portion 108*a* as shown in FIG. 3.

The front and rear engaging ends 108*b* of the hook member 108 are mounted to the front frame member 101 and rear frame member 102 by pins 100 in such a manner that the hook member 108 can be turned outward and inward about the pins 100. There is also provided a spring 20 between the release lever 9 and the slant portion 107*e* of the positioning member 107 to push the release lever 9 down.

As seen in FIGS. 3 and 9, there are provided front and rear brackets 19 and 19' at appropriate positions in the upper portion of the lower body 11 for holding a pair of registration rollers 29 to be described later. Each of the brackets 19 and 19' is a one-piece metal member which is made by cutting and bending a single metal plate into a specified shape. The front bracket 19 has an eyelet 18 for locking one of the engaging ends 108*b* of the hook member 108 and members 421 and 422 for positioning paper feed rollers to be described later. Similarly, the rear bracket 19' includes an eyelet 18' for locking the other engaging end 108*b* and a member 421' for positioning the paper feed rollers. The rear bracket 19' is additionally provided with a projection 191' fittable in the cutout 107*a* of the positioning member 107.

The eyelets 18 and 18', positioning members 421,421' and 422 for the paper feed rollers 23 and the mounting mechanism of the registration rollers 29 will be described later in detail.

As the upper body 10 swings down in the clockwise direction, the projection 191' automatically fits into the cutout 107*a* of the positioning member 107 to set the lowermost position of the upper body 10 to prevent any displacement in the longitudinal direction.

As previously mentioned, the cutout 107*a* has the fan-like portion 107*b* and hole portion 107*d*. Accordingly, the projection 191' smoothly fits into the cutout 107*a* of the positioning member 107 even when they are inclined from each other. The projection 191' eventually hits against the far end of the cutout 107*a* to set the upper body 10 at the correct descending position.

It should be noted that the shape of the cutout 107*a* is not limited to the one shown in FIG. 8B as long as there are provided a narrow entry portion 107*c* for preventing horizontal displacement of the upper body 10 and an hole portion 107*d* for regulating the downward stroke. As another cutout of the present invention, it may be appropriate to form the hole portion into a long rectangular shape having almost the same width as the narrow entry portion 107*c*.

Further, it may be appropriate to provide the positioning member 107 on the lower body 11 and the projection 191' on the upper body 10.

Figure 11:
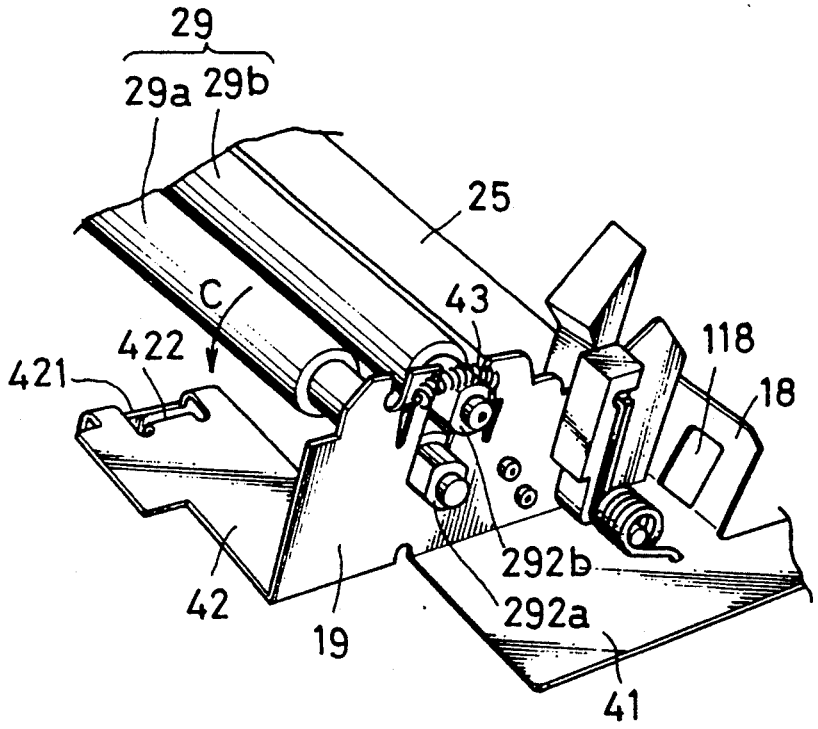
FIG. 11 is a perspective view showing a construction of a bracket on the, front.

As shown in FIG. 11, the front bracket 19 has an outside base plate 41 and an inside base plate 42 individually bent at right angles to an upright portion of the bracket 19. Further, the outside base plate 41 has the aforementioned eyelet 18 bent toward the upright portion of the bracket 19. The rear bracket 19' also has an outside base plate 41', inside base plate 42', and eyelet 18' formed in a similar manner. The eyelets 18 and 18' have eyes 118 and 118' at specified portions, respectively.

The hook member 108 is pushed inward by the resilient force of the spring 20 via the release lever 9 until the projections 108*c'* of the engaging ends 108b come into contact with the positioning member 107, where the engaging ends 108*b* and 108*b'* are in an upright position. In this position, the hooks 108*d* and 108*d'* snap into the eyes 118 and 118', respectively, to lock the upper body 10 to the lower body 11. When the release lever 9 is lifted upward, the hook member 108 turns counterclockwise, causing the hooks 108*d* and 108*d* to unlatched from the eyes 118 and 118' into an unlocked position.

As seen in the above description, when the upper body 10 turns clockwise about the pivot shaft 14 and the right side of the upper body 10 descends to a certain position, the projection 191' of the bracket 19' slips into the cutout 107*a* of the positioning member 107 to control the closing action of the upper body 10. Therefore, the above configuration prevents mutual displacement between the upper body 10 and the lower body 11 in the longitudinal and vertical directions, and the members carried by the bodies are exactly positioned to each other.

Referring again to FIG. 21, the document D placed on the document feeder tray 2 is fed from right to left (as shown by arrow A), scanned by the image reading means 17 located under the control panel 3, and discharged to the original discharge tray 5.

The image signal obtained by the image reading means 17 as it scans the document D is once stored in an internal memory (not illustrated) of the facsimile machine. The stored image signal is then read out for transmission or copying depending on the mode of facsimile transmission or copying.

More specifically, when the facsimile transmission mode is selected, the image signal is sequentially read out of the memory and transmitted to a facsimile machine of a desired recipient via a telephone line. When the copying mode, an image of the original document is formed on the copy sheet using the image signal read from the memory.

Figure 2:
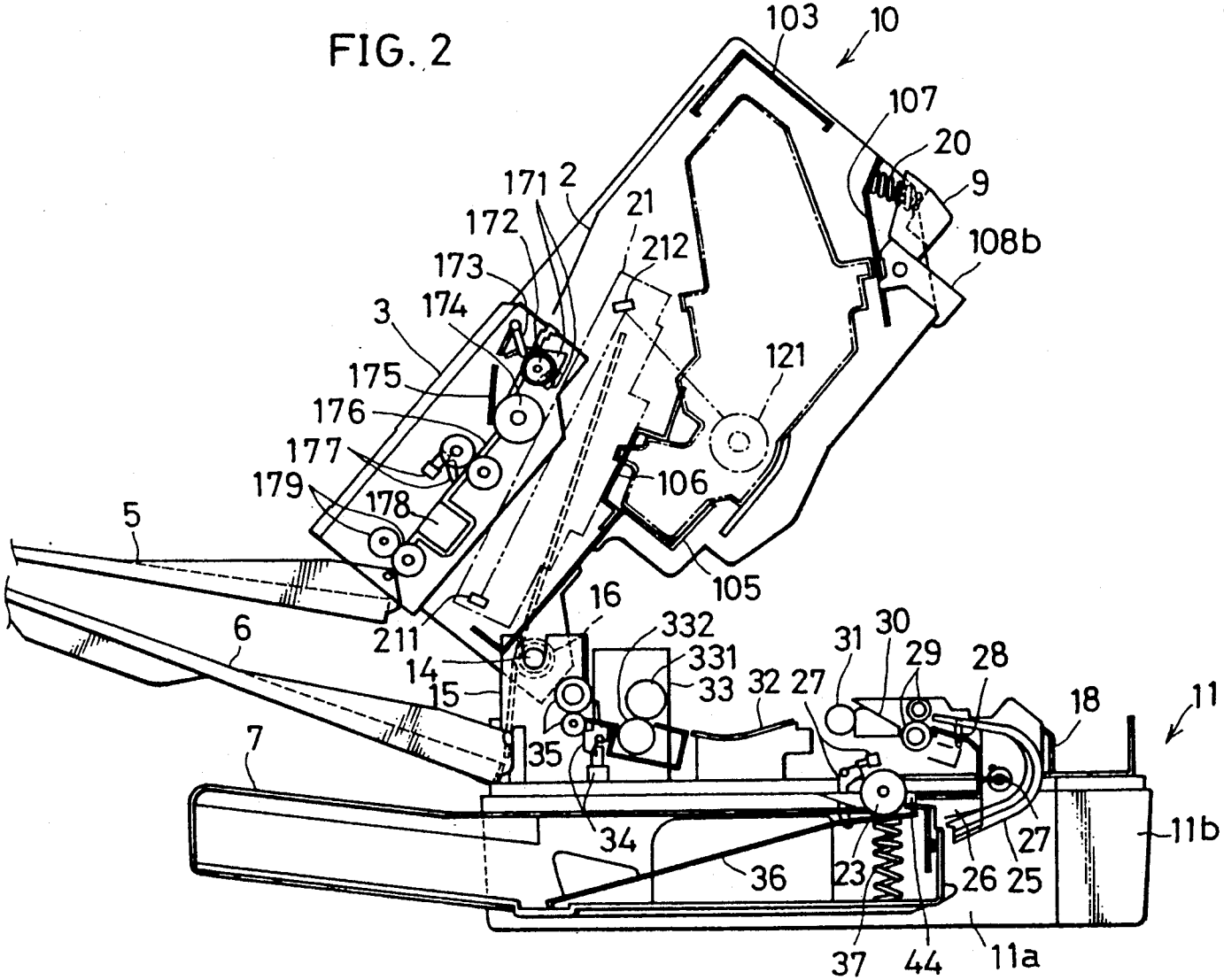
FIG. 2 is a diagram schematically showing the internal construction of the facsimile machine in an opened position.

Referring now to FIG. 1 showing an internal construction of the aforementioned facsimile machine in the closed state, and FIG. 2 showing the internal construction of the facsimile machine in the opened state, the main body of the facsimile machine carries the image reading means 17, image forming means 120 including the developing unit 12, optical unit 21, copy paper cassette 7, and a paper feeding mechanism for feeding the copy paper sheet from the copy paper cassette 7 to the image forming means 120. As previously described, the main body 1 is opened almost along the horizontal paper path to assure easy access to the internal elements.

As already mentioned, the image reading means 17, the image forming means 120 and the optical unit 21 are arranged inside the upper body 10. The optical unit 21 scans an image of the document and sends a light image to the photosensitive drum 121. The image printing unit 120 includes the photosensitive drum 121 and other peripheral elements including developing unit 12, cleaning unit and charger surrounding the photosensitive drum 121.

On the other hand, there are provided in the upper portion of the lower body 11 the paper feeding mechanism for feeding copy paper sheets from the copy paper cassette 7 to the photosensitive drum 121, transfer roller 31 pressed against the photosensitive drum 121 for transferring the toner image onto the copy paper, transfer guide 32 for guiding the copy paper to a fixing unit 33 after the transfer process. The fixing unit 33 includes a heating roller 331 and a pressure roller 332, and a pair of output rollers 35 for discharging the copy paper sheet to the copy paper sheet discharge tray 6 after fixing.

The paper feeding mechanism includes a guide member 24, a U-turn paper guide 25 and an upper paper guide 30 as well as the previously mentioned copy paper cassette 7, paper feed rollers 23 and a pair of registration rollers 29. The registration rollers 29, upper paper guide 30, transfer roller 31, transfer guide 32 and output rollers 35 together form the aforementioned horizontal paper path while the paper feed rollers 23, guide member 24 and U-turn paper guide 25 form a U-turn paper path for guiding the paper fed from the copy paper cassette 7 to the horizontal paper path upward.

Furthermore, there are provided copy paper sheet sensors 22, 28 and 34 at appropriate positions on the upstream of the paper feed rollers 23, registration rollers 29 and output rollers 35, respectively. The construction of the paper feeding mechanism will be described later in further detail.

The image forming means 120 is inserted through the passage 10*a* in the upper body 10. The image reading means 17 is mounted in an upper left position of the upper body 10 while the optical unit 21 is disposed beneath the image reading means 17.

In the image reading means 17 are provided, from upstream (starting from the document feeder tray 2), a document sensor 171, a document feed roller 172, a document presser 173, a paper separating roller 174, a separator plate 175, a pair of conveying rollers 176, a document sensor 177, an image sensing apparatus 178 and a pair of output rollers 179.

The document sensors 171 and 177 and the copy paper sheet sensors 22, 28 and 34 each are made of an photointerruptor and a shielding plate.

When the document sensor 171 detects a stack of original document sheets loaded on the document feeder tray 2, the document feed roller 172 feeds them into the image reading means 17. Only the lowermost sheet is separated by the separating roller 174 and separator plate 175 and sent forward to the conveying rollers 176 to enable reading or facsimile transmission. When a "start" command is entered, the conveying rollers 176 feed the document sheet to the image sensing device 178 at a specified speed.

The image sensing device 178 scans the document sheet being fed across a predetermined range and the resultant image signal is stored in the internal memory (not illustrated). While the document sheet is being read by the image sensing device 178, it is detected by the document sensor 177. The output of the document sensor 177 is used to judge that the reading process is in progress. The output is reset to a "zero" level when the rear edge of the original passes the document sensor 177. As a result, it is judged that the reading process has been finished. Then, the document sheet is discharged to the original document discharge tray 5 by the discharging rollers 179 and a next sheet of original document is sent to the conveying rollers 176. The stack of original document sheets are read one after another in the above-mentioned manner.

Provided with light emitting means 211 for producing a laser beam, a polygon mirror (not illustrated) and a deflecting mirror 212 for directing the laser beam toward the photosensitive drum 121, the optical unit 21 projects the laser beam modulated by a digitized image signal onto the photosensitive drum 121 to produce a latent image on the drum surface.

In an intermediate portion of the left side of the lower body 11 is formed a mounting portion 11*a* for mounting the copy paper cassette 7. The lower body 11 also carries a circuit board compartment 11*b* at the right side for accommodating a power supply circuit. Inside the lower body 11, there are provided paper feed rollers 23 above a forward end of a paper push-up plate 36 of the copy paper cassette 7.

Figure 12:
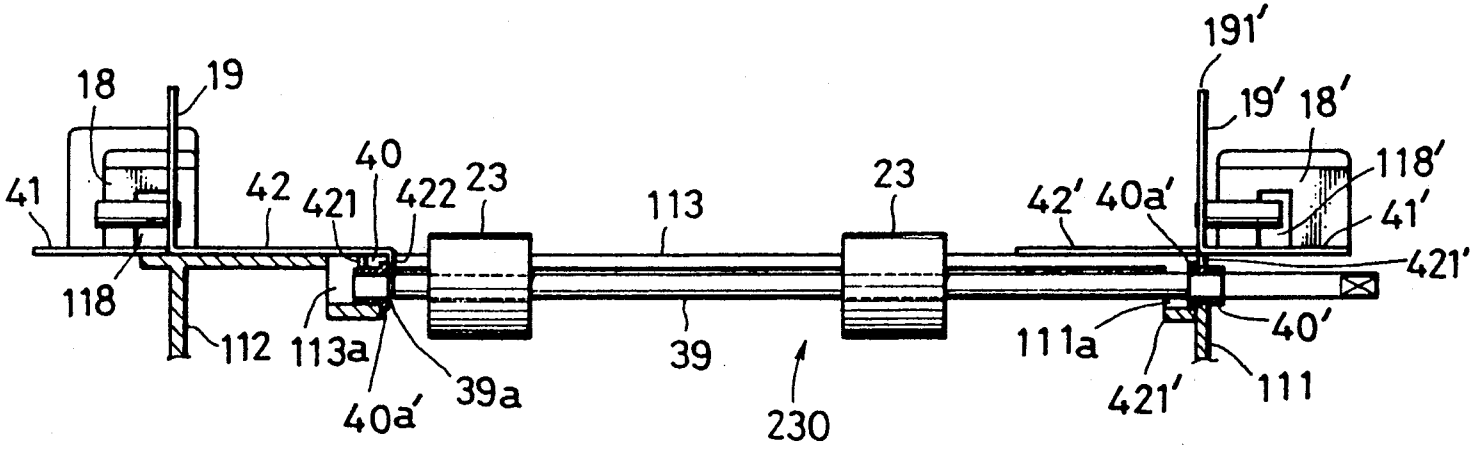
FIG. 12 is a sectional view showing mounting of paper feed rollers.

FIG. 12 is a fragmentary cross sectional view showing how the paper feed rollers 23 are mounted.

A feed roller assembly 230 includes a pair of paper feed rollers 23 separated from each other by a specified distance. The paper feed rollers 23 are fixedly attached on an intermediate portion of a rotating shaft 39 which is supported by bearings 40 and 40' at the left end and at a slightly inward position from the right end, respectively. The bearings 40 and 40' are each formed with a flange 40*a'*. The rotating shaft is formed with a circumferential groove 39*a* at portion close to the inside surface of the bearing 40. A driving gear (not illustrated) is mounted at the right end of the rotating shaft 39. On the other hand, there is a slot in a longitudinal direction at an appropriate position on a top plate 113 of the lower body 11. The top plate 113 is connected with a rear plate 111 and a front plate 112. A pair of supports 113*a* and 111*a*, each having a semicircular cross section, are formed at a front end of the slot and at a slightly inward position from the rear end of the slot, respectively. The support 111*a* is located immediately above an upper end of the rear plate 111 of the lower body 11.

The paper feed roller assembly 230 is mounted at an appropriate position in relation to the copy paper cassette 7 in the lower body 11 by placing the bearings 40 and 40' on top of the supports 113*a* and 111*a*, respectively. Vertical and axial displacements of the feed roller assembly 230 are restricted by the brackets 19 and 19' attached to the lower body 11.

More specifically, the front bracket 19 has the previously mentioned positioning members 421 and 422 formed by bending down the inner ends of the inside base plate 42 as shown in FIG. 11. Similarly, the rear bracket 19' has the positioning member 421' projecting downward from a position between the outside base plate 41' and inside base plate 42'.

When the front and rear brackets 19 and 19' are mounted at their respective positions on the top of the lower body 11, the positioning members 421 and 421' ride on top of the bearings 40 and 40', respectively. As a result, the positioning members 421 and 421' restrict vertical displacement of the rotating shaft 39. Also, the positioning member 422 fits into the groove 39*a* of the rotating shaft 39 to restrict axial displacement of the rotating shaft 39.

As seen above, the bearings 40 and 40' attached to the rotating shaft 39 of the paper feed rollers 23 are mounted by placing them on top of the supports 113*a* and 111*a* provided in the lower body 11. The paper feed roller assembly 230 can be easily mounted on the lower body 11. In the arrangement described above, the lower body 11 also carries the positioning members 421 and 421' formed in the base plates 42 and 42' of the brackets 19 and 19', respectively, for restricting vertical displacement of the bearings 40 and 40', the positioning member 422 formed in the inside base plate 42 for restricting axial displacement of the rotating shaft 39, and the supports 111*a* and 113*a* for restricting displacement of the bearings 40 and 40' in the paper feeding direction. Accordingly, the feed roller assembly 230 can be securely held in position with a simple mechanical structure.

Figure 13:
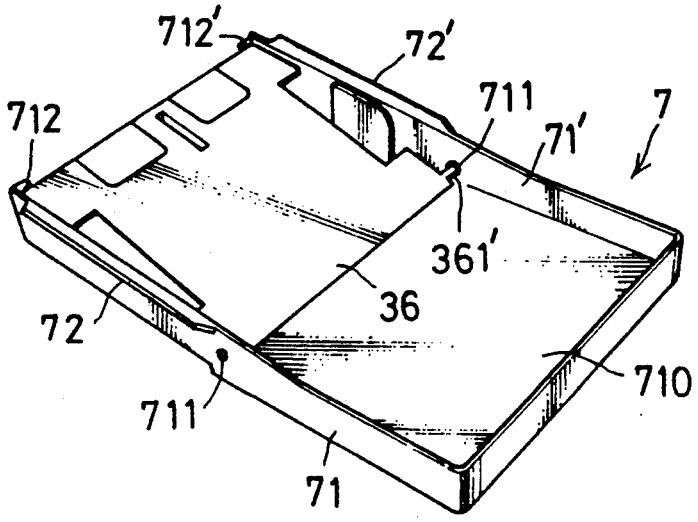
FIG. 13 is a perspective view showing a copy paper cassette.

FIG. 13 is a perspective view showing an external appearance or the copy paper cassette 7.

The copy paper cassette 7 is provided with guide plates 72 and 72' at forward portions of side members 71 and 71' which stand vertically on both sides of a bottom plate 710. In a forward half of the copy paper cassette 7, there is provided a paper push-up plate 36 made of an electrically conductive metal. The paper push-up plate 36 has a pair of projections 361 and 361' serving as pivots, These pivots 361 and 361' are fitted into holes 711 and 711' in the side members 71 and 71', respectively, to serve as axis of rotation about which the paper push-up plate 36 can swing up and down. A forward portion of the paper push-up plate 36 is loaded on a spring 37 as shown in FIG. 1 in order to push up the corresponding area of cut sheets stacked in the copy paper cassette 7. It would be recognized, therefore, that the leading-end portion of the cut sheets is pressed against the bottom of the paper feed rollers 23. At an upper forward corners of the copy paper cassette 7, there are provided paper retaining tabs 712 and 712'. These tabs 712 and 712' align leading edges of the copy paper sheets and keep them within the copy paper cassette 7 as they are forced upward by the paper push-up plate 36.

Figure 14:
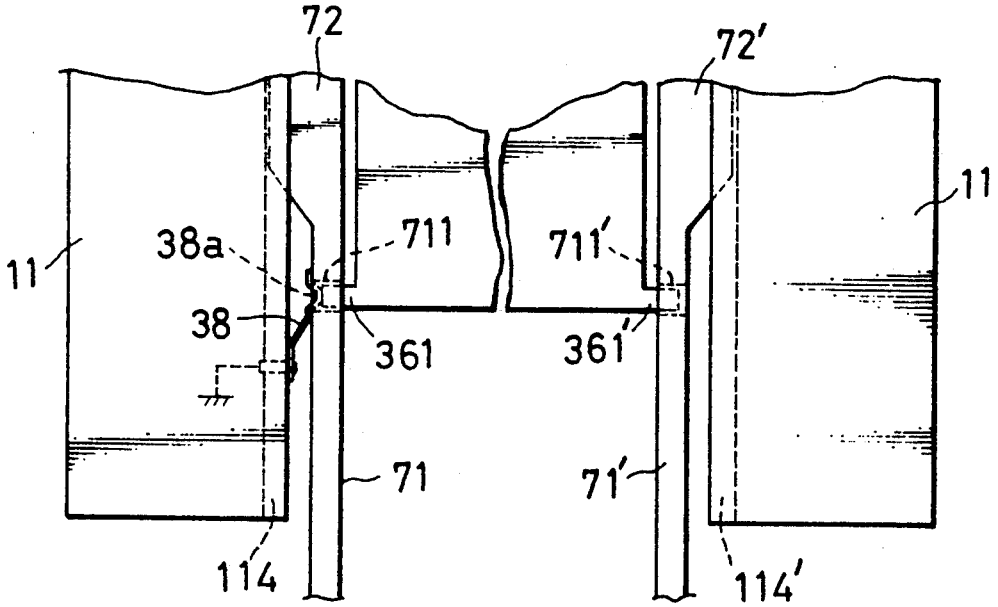
FIG. 14 is a plan view showing mounting of the copy paper cassette into the main body.

When the copy paper cassette 7 is inserted into the mounting portion 11*a* of the lower body 11, the guide plates 72 and 72' slide into guide grooves 114 and 114' formed on the inner walls of the lower body 11 as shown in FIG. 14. On an inner wall of the lower body 11, a leaf spring 38 is attached face to face with the side member 71 of the paper cassette 7. Made of an electrically conductive metal, the leaf spring 38 is grounded at one end with its foremost end 38*a* protruding into the space of the hole 711. As the paper cassette 7 is inserted into the hole 711, the foremost end 38*a* of the leaf spring 38 slides along the side member 71 until it fits into the hole 711 in the side member 71. At this point, the leaf spring 38 presses against the projection 361 of the paper push-up plate 36, whereby the paper push-up plate 36 is grounded via the leaf spring 38.

The above-mentioned construction which is simple in construction prevents accumulation of electrostatic charges in the paper push-up plate 36 that is likely to occur due to the friction between copy sheets when they are fed from the copy paper cassette 7. With this arrangement, electrostatic adhesion is effectively reduced to provide smooth feed of the copy paper sheets, preventing multi feeding of copy paper sheets from the paper cassette 7, jams in the paper path, and other paper handling problems.

Referring again to FIG. 1, on the downstream of the paper feed rollers 23, there are provided an angled guide member 24 and a U-turn paper guide 25 having a U-shaped cross section. The gently curved inner surface of the U-turn paper guide 25 faces the guide member 24 to provide a U-turn path for guiding the paper fed from the copy paper cassette 7 toward the registration guide rollers 29 provided above the paper feed rollers 23.

Figure 15:
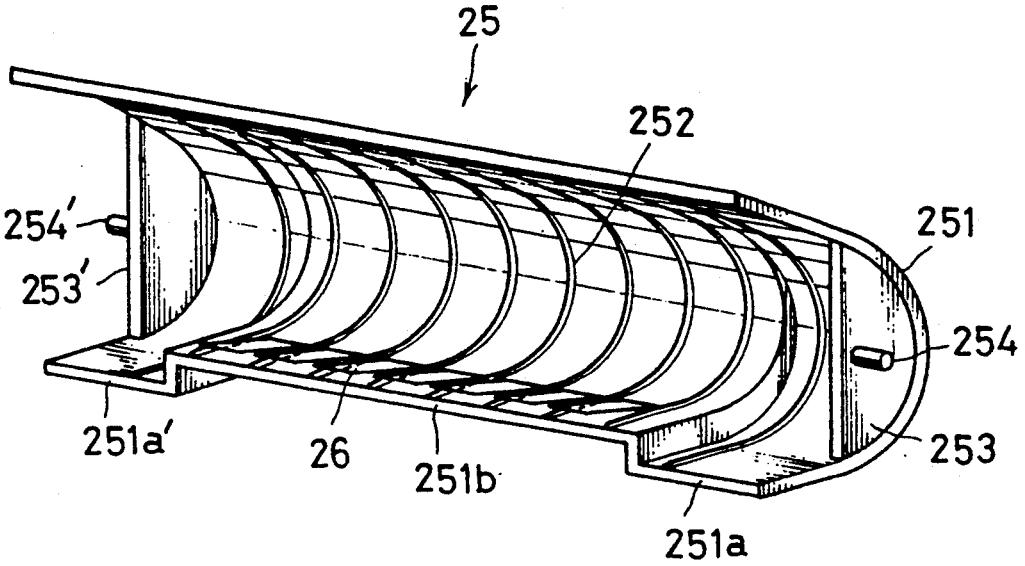
FIG. 15 is a perspective view showing a U-turn guide plate.

FIG. 15 is a perspective view showing an external appearance of the U-turn guide plate 25.

The U-turn paper guide 25 is formed into a roughly semi-cylindrical structure having a U-shaped cross section. The U-turn paper guide 25 has slightly larger width than the copy paper sheet. A U-turn plate 251 is curved at predetermined curvature so that the copy paper sheet is guided along its inner surface. There are formed a plurality of parallel ribs 252 aligned in the paper feeding direction on the inner surface of the U-turn plate 251. The U-turn plate 251 is shaped in such a manner that its outside portions 251*a* and 251*a'* have a greater curvature than its central portion 251*b*. When mounted, an upper end (downstream) of the U-turn plate 251 becomes nearly horizontal. On the other hand, a lower end (upstream) of the U-turn plate 251 is designed in the following manner. As seen in FIG. 15, the outside portions 251*a* and 251*a'* are stepped down from the central portion 251*b*. The outside portions 251*a* and 251*a'* of the U-turn paper guide 25 have a greater curvature than the central port ion 251*b*.

When the paper feed rollers 23 feed the copy paper sheet from the paper cassette 7, its leading end goes into the U-turn paper guide 25. Since the outside portions 251*a* and 251*a'* are stepped down from the central portion 251*b*, the leading end of the copy paper sheet first gets into contact with the central portion 251*b* with its both corners free from the U-turn plate 251. Subsequently, the cut sheet is smoothly guided along the U-turn plate 251 as will be discussed in further detail in the following.

Copy paper sheets are apt to be creased at both corners on the leading end as they are retained in the copy paper cassette 7 by the paper retaining tabs 712 and 712'. When each sheet is pushed out by the paper feed rollers 23 from the copy paper cassette 7 onto the U-turn plate 251, the leading end corners of the sheet tend to hang down. Even in such situations, the sheet can be guided along the U-turn plate 251 without hitting the outside sections 251*a* and 251*a'* or being folded back at the hanging corners. It would be recognized that smooth feed of the copy paper sheet is achieved by the above-mentioned construction of the U-turn plate 251 having the stepped outside portions 251*a* and 251*a'* on both sides of the central portion 251*b*.

Furthermore, the upper portion of the U-turn plate 251 is formed to provide a straight paper path extending up to the point where the registration rollers 29 nip the copy paper sheet, Accordingly, while the paper slides along the inner surface of the U-turn plate 251, the leading end of the copy paper sheet is fed straight and caught in between the registration rollers 29. It would be appreciated, therefore, that the upper portion of the U-turn plate 251 designed in the manner described above can guide the leading end appropriately.

Figure 16:
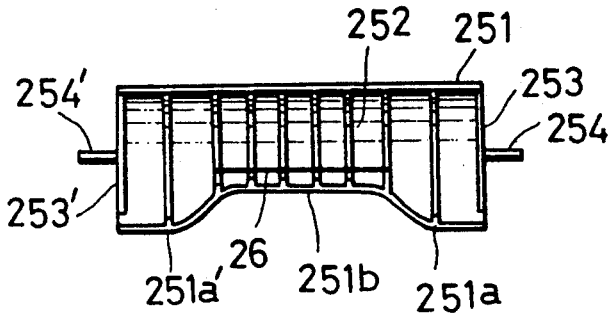
FIG. 16 is a plan view showing a modified U-turn guide plate.

It is to be noted in the above connection that the design of the U-turn plate 251 is not limited to the one indicated in FIG. 15 as long as the outside portions 251*a* and 251*a'* are lower than the central portion 251*b*. As an example, the outside portions 251*a* and 251*a'* of the U-turn plate 251 may be curved gradually downward from the central portion 251*b* as shown in FIG. 16.

Referring again to FIG. 15, the U-turn paper guide 25 is furnished with damping means 26 made of an elastic material. Attached to the inner surface of the U-turn plate 251 close to a lower end of its central portion 251*b*, the damping means 26 juts out in the upstream direction with its tips slightly raised. The damping means 26 is intended to prevent the paper from making noise as its trailing edge leaves the paper cassette 7 onto the U-turn plate 251.

Figure 17:
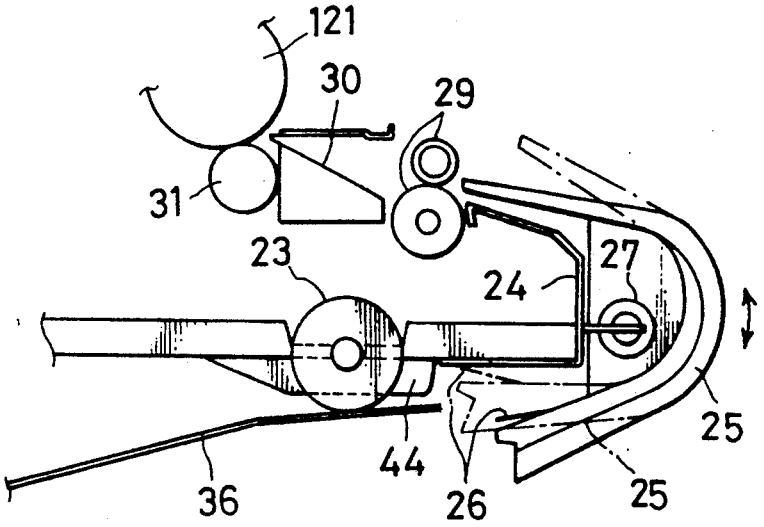
FIG. 17 is a side elevation view showing rotation of the U-turn guide plate.

The effect of the damping means 26 will be seen in more detail in the following. To provide smooth feed from the copy paper cassette 7 to the U-turn paper guide 25, the lower end of the U-turn paper guide 25 is positioned slightly below the end of the paper push-up plate 36 in the "out-of-paper" state as shown in FIG. 17. When the trailing end of the paper is just leaving the copy paper cassette 7, a forward half of the copy paper sheet is curled within the U-turn paper guide 25. When the trailing end of the paper is relieved of the paper push-up plate 36, the resistive force of the paper causes the trailing end to hit against the lower end of the U-turn plate 251 due to the height difference between the paper push-up plate 36 and the U-turn paper guide 25. The damping means 26 absorbs the resultant impact and pass the trailing end onto the U-turn plate 251 without producing noise.

Furthermore, the U-turn paper guide 25 is provided with pivots 254 and 254' projecting outward from side members 253 and 253', respectively. Mounted on side members (not illustrated) of the lower body 11 by these pivots 254 and 254', the U-turn paper guide 25 can be turned as shown in FIG. 17 when the main body 1 is opened by lifting up the upper body 10. With this arrangement, jammed paper can be easily removed since the gap at the upper end of the U-turn paper guide 25 can be broadened by turning it clockwise as shown by phantom lines in FIG. 17.

Referring again to FIG. 20A–20C, a bottom portion 24*a* of the aforementioned guide member 24 serves as inside guide plate for guiding the copy paper to the U-turn paper guide 25 as it is pushed out by the paper feed rollers 23 in an upper-right direction out of the copy paper cassette 7. On the other hand, a top portion 24*b* of the guide member 24 serves as inside guide plate for guiding the copy paper along the U-turn paper guide 25 up to the registration rollers 29.

Figure 18:
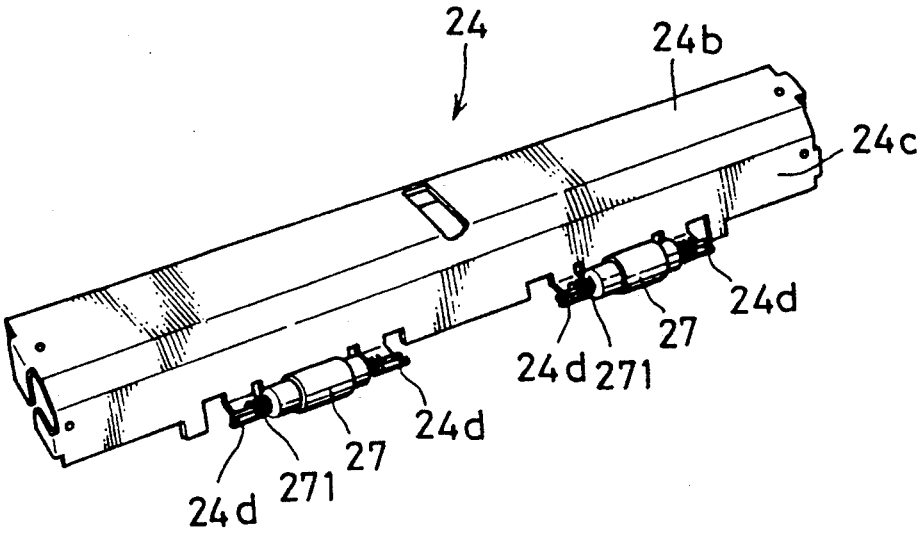
FIG. 18 is a perspective view showing rollers mounted on a vertical body of a guide plate.

To a vertical portion 24*c* of the guide member 24 are attached a pair of idle rollers 27, for example, at appropriate positions in a lengthwise direction of the guide member 24. For example, each of these rollers 27 is suspended by a coil spring mounted between supports 24*d* projecting from the lower end of the vertical section 24*c* as shown in FIG. 18. In this arrangement, the coil spring serves as a shaft 271 for each roller 27. Working together with the U-turn paper guide 25, the rollers 27 assure smooth inverting of the copy paper sheet. By using coil springs, the structure can be made lightweight and inexpensive. As a modified form, the shaft 271 may be made of a normal rod. Furthermore, the shafts 271 may be fitted tight or loose into the rollers 27.

Figure 19:
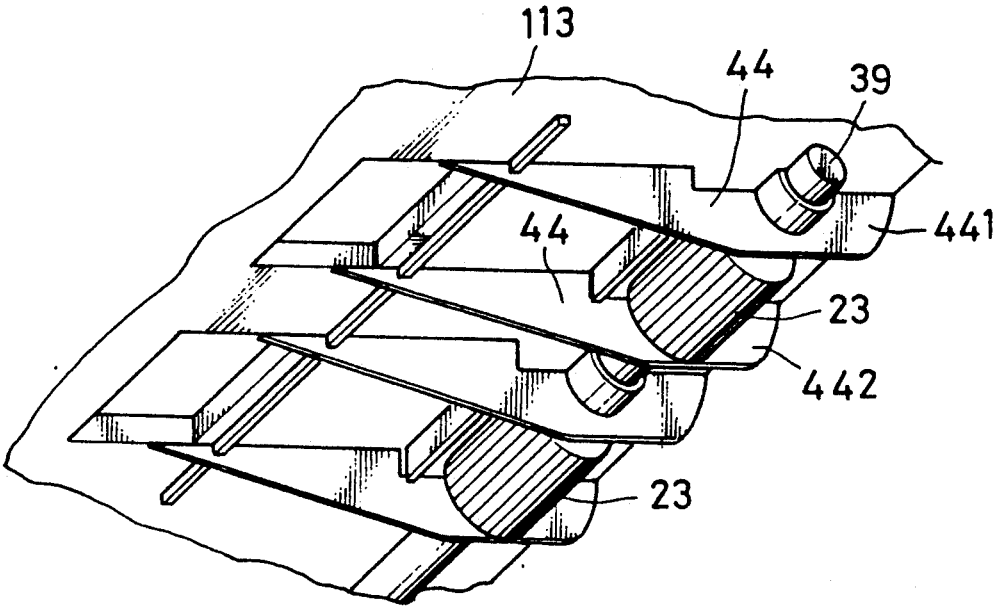
FIG. 19 is a perspective view showing a construction of paper guides provided at the paper feed rollers.

Referring now to FIG. 19, there are provided paper guides 44 aligned in parallel with the paper feeding direction of the individual paper feed rollers 23. These paper guides 44 may be formed as integral part of the top plate 113 of the lower body 11 or attached to the bottom of the top plate 113 at appropriate positions, as shown in FIG. 19. Each paper guide 44 is furnished with vertical guide plates 441 and 442 on both sides of the paper feed roller 23, having a tapered surface on the upstream and a horizontal surface having a specified length on the downstream. With this arrangement, the paper guides 44 serve to guide the copy paper sheet smoothly to the paper feed rollers 23 and to prevent the paper feed rollers 23 from entangling the copy paper being fed or catching the paper again as it is pushed back from the U-turn paper guide 25. The feature of the paper guides 44 of preventing jams will be described later in further detail.

Figure 20A:
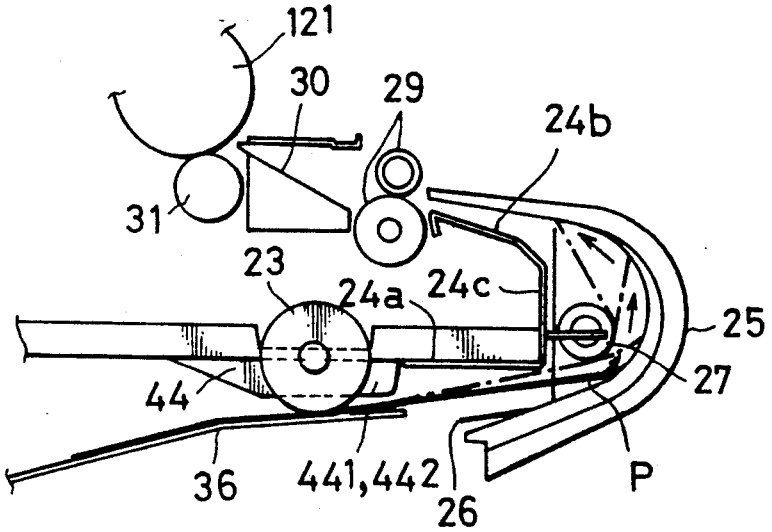
FIGS. 20A. 208. and 20C are side elevation views showing paper feeding states.
Figure 20B:
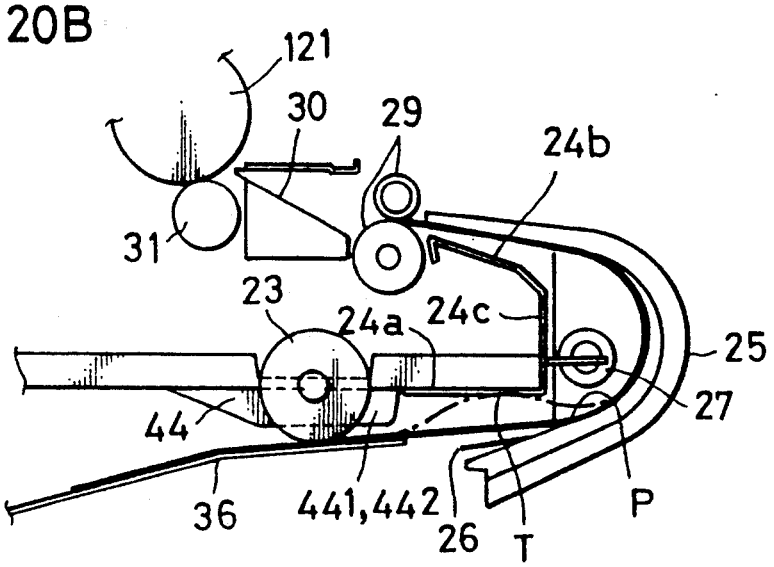
Figure 20C:
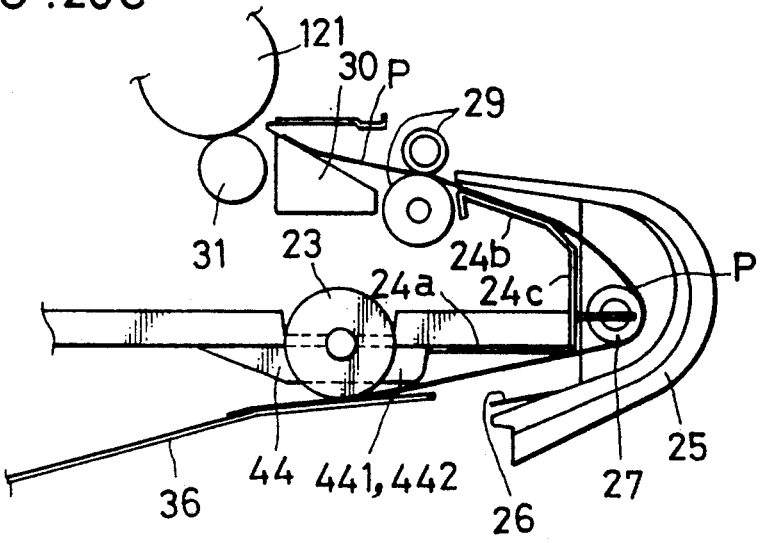

FIGS. 20A, 20B, and 20C are diagrams showing paper feeding states where the leading end of the copy paper has just gone onto the U-turn guide plate 25, the leading end of the copy paper is just nipped by the registration rollers 29, and the copy paper is being fed by the registration rollers 29, respectively.

As the paper feed rollers 23 feed the copy paper P from the copy paper cassette 7 into the U-turn paper guide 25, its leading end gets in contact with the U-turn plate 251. The leading end slides along the inner surface of the U-turn plate 251 and the feed direction is turned to a nearly opposite direction. At this point, an intermediate portion of the copy paper P comes into contact with the rollers 27 and the copy paper P is bent at the contact point as shown by phantom lines in FIG. 20A. While the copy paper P is further conveyed, the copy paper P is properly bent by the rotation of the rollers 27. Owing to the resistive force of the bent portion of the copy paper, the leading end of the copy paper P is kept slightly pressed against the inner surface of the U-turn plate 251 all the way to the upstream portion of the rollers 27, allowing smooth and assured feeding up to the registration rollers 29.

While the copy paper P is guided along the U-turn plate 251, the registration rollers 29 are kept in a stationary state The paper feed rollers 23 continue to rotate even after the leading end of the copy paper P has gone into contact with the registration rollers 29. This causes a bulge T near the trailing end of the paper P, as shown by a phantom line in FIG. 20B, while an intermediate portion of the copy paper sheet is fitted to the shape of the U-turn plate 251 as illustrated.

The guide plates 441 and 442 of the paper guides 44 prevent the bulge T of the paper P from being pushed back and entangled by the paper feed rollers 23. Further, if the guide plates 441 and 442 are given a specified length on the downstream, the top of the bulge T will be pressed against the bottom body 24*a* of the guide member 24. As a result, the contact pressure at the leading end of the copy paper P is regulated widthwise and skew or obliqueness of the paper P is thus eliminated.

The registration rollers 29 start rotating to feed the copy paper P at a proper timing with the subsequent image transfer process. At this point, the copy paper P again comes into contact with the rollers 27 and is guided smoothly along the top portion 24*b* of the guide member 24 as both the bottom portion 24*a* and rollers 27 give minimal friction.

It is to be recognized in connection with the above description that unless the guide member 24 is provided with the bottom portion 24*a*, an excessive bulge T will develop in the copy paper P, causing its leading end to hit the inner surface of the U-turn plate 251 at a large contact angle. In this state, the paper P may buckle and jam directly at its bulged area, or go astray from the inner surface of the U-turn paper guide 25, resulting in an eventual jam. In the embodiment disclosed above, the guide member 24 is furnished with the low-friction, free-rotation rollers 27 in addition to the bottom body 24*a*. The rollers 27 guides the copy paper P smoothly onto the U-turn paper guide 25 without causing a bulge in the copy paper P. In consequence, a desired bent is maintained in the copy paper P, making it possible to guide the copy paper P along the inner surface of the U-turn plate 251.

Referring again to FIG. 1, there are provided a pair of registration guide rollers 29 on the downstream of the guide member 24. The pair consists of a driving roller 29*a* and a driven roller 29*b* mounted on the brackets 19 and 19' (19' not illustrated) with bearings 292*a* and 292*b* attached to both ends of the respective rollers as shown in FIG. 11. More specifically, there are formed slotted cutouts 192 with U-shaped ends in the brackets 19 and 19' and the bearings 292*a* and 292*b* are fitted into these cutouts 192 in such a manner that the driving roller 29*a* is located on the bottom. The bearing 292*b* at each end of the driven roller 29*b* is pulled down toward the bottom of the slotted cutout 192 with a desired force by means of a spring 43 mounted across the opening of the slotted cutout 192. The springs 43 on the front and rear sides hold the registration guide rollers 29 in the slotted cutouts 192 and produce a pressure between the two rollers. This arrangement will stabilize the mutual positioning of the driving roller 29*a* and driven roller 29*b* and simplify their mounting structure.

With the above arrangement, the copy paper is fed from the copy paper cassette 7 by means of the paper feed rollers 23 and conveyed along the U-turn paper guide 25 up to the registration rollers 29 provided above the paper feed rollers 23 before the image forming means performs the image forming of an image of facsimile transmission or original document. Thereafter, the registration rollers 29 feed the copy paper to the photosensitive drum 121 in synchronism with the exposure timing of the optical unit 21, driving the transfer roller 31 to transfer a toner image from the photosensitive drum 121 to the copy paper. Finally, the fixing unit 33 fixes the toner image on the copy paper and the discharge rollers 35 discharge the copy paper to the copy paper discharge tray 6.

What is claimed is:

1. An image forming apparatus comprising:

a lower body having a pivot shaft on one side;

an upper body connected to the lower body and rotatable about the pivot shaft between a closed state and an open state, said upper body comprising a front frame member made of resin, a rear frame member made of resin, and a connecting member made of metal between the front frame member and the rear frame member for connecting the front and rear frame members;

image forming means having an image bearing member for forming a toner image on the image bearing member;

paper storage means provided on the lower body for storing sheets; and paper feeding means provided in the lower body for feeding sheets from the paper storage means to the image forming means;

whereby the paper feeding means is exposed when the upper body is in the opened state.

2. an image forming apparatus according to claim 1 wherein at least one of said front and rear frame members includes a vertical portion and a flange portion formed on a periphery of the vertical portion, the vertical and flange portions being connected to the connecting member.

3. An image forming apparatus according to 1 further comprising image reading means having opposite ends fixedly connected to the front and rear frame members.

4. An image forming apparatus comprising:

a lower body having a pivot shaft on one side;

an upper body connected to the lower body and rotatable about the pivot shaft between a closed state and an open state;

An image forming means having an image bearing member for forming a toner image on the image bearing member, the image forming means including an operable unit detachably mountable on the upper body, the upper body having a front frame member having a guide passage for guiding the mounting of the operable unit on the upper body;

paper storage means provided on the lower body for storing sheets; and paper feeding means provided in the lower body for feeding sheets from the paper storage means to the image forming means;

whereby the paper feeding means is exposed when the upper body is in the opened state.

5. An image forming apparatus according to claim 4 wherein the guide passage is flared in an outward direction.

6. An image forming apparatus according to claim 5 wherein the image forming means includes a rear frame member and a connecting member connected between the front and rear frame members, the connecting member being disposed in such a position as to guide the mounting of the operable unit on the upper body.

7. An image forming apparatus comprising:

a lower body having a pivot shaft on one side;

an upper body connected to the lower body and rotatable about the pivot shaft between a closed state and an open state;

one of the upper body and lower body being provided with positioning means including a hole portion, and the other of the upper body and lower body being provided with a projection fittable in the hole portion when the upper body is placed in the closed state;

image forming means having an image bearing member for forming a toner image on the image bearing member;

paper storage means provided on the lower body for storing sheets; and paper feeding means provided in the lower body for feeding sheets from the paper storage means to the image forming means;

whereby the paper feeding means is exposed when the upper body is in the opened state.

8. An image forming apparatus according to claim 7; further comprising a pair of registration rollers for controlling the feeding of a sheet to the image bearing member, wherein the upper body has a connecting member which is formed with a cutout having a hole portion and a narrow entry portion, and the projection is formed on a supporting plate for supporting the registration roller pair.

9. An image forming apparatus comprising:

a lower body having a pivot shaft on one side;

an upper body connected to the lower body and rotatable about the pivot shaft between a closed state and an open state;

image forming means having an image bearing member for forming a toner image on the image bearing member;

paper storage means provided on the lower body for storing sheets;

feed roller means provided on a downstream side of the paper storage means for feeding sheets from the paper storage means, the feed roller means including a feeding roller and a supporting shaft having opposite ends with the opposite ends having mounting portions;

feed roller supporting members for supporting the feed roller means, the supporting members including a plate fixedly attached to the lower body and formed with an oblong cutout for holding the mounting portions of the feed roller means, the cutout facing upward;

restricting means detachably provided on the lower body for holding the mounting portions of the feed roller means from moving upward when the upper body is placed in the closed state; and paper feeding means provided in the lower body for feeding sheets from the paper storage means to the image forming means;

whereby the paper feeding means is exposed when the upper body is in the opened state.

10. An image forming apparatus according to claim 9 wherein said paper feeding means includes paper inverting means provided between the paper storage means and the image bearing member for inverting the sheet fed from the paper storage means, a pair of registration rollers for controlling the feeding of a sheet to the image bearing member, the pair of registration rollers being provided between the image bearing member and the paper inverting means, each roller having opposite ends provided with mounting portions, wherein the restricting means includes registration roller supporting members attached on the lower body for supporting the pair of registration rollers, the registration roller supporting members including a portion for holding the mounting portions of the feed roller means in place.

* * * * *

UNITED STATES PATENT AND TRADEMARK OFFICE

CERTIFICATE OF CORRECTION

PATENT NO. : 5,331,374

DATED : July 19, 1994

INVENTOR(S) : Yuji Abe, et al

It is certified that error appears in the above-indentified patent and that said Letters Patent is hereby corrected as shown below:

On the title page, item [75] Inventors: "Masahiki Miyazaki" should read -- Masahiko Miyazaki--.

Signed and Sealed this

Fourteenth Day of March, 1995

*Attest:*

Bruce Lehman

BRUCE LEHMAN

*Attesting Officer*

*Commissioner of Patents and Trademarks*